United States Patent [19]

Giuffredi

[11] 4,215,804

[45] Aug. 5, 1980

[54] MANUAL CONTROL DISPENSING PUMP FOR LIQUID CONTAINERS

[75] Inventor: Giancarlo Giuffredi, Milan, Italy

[73] Assignee: Coster Tecnologie Speciali S.p.A., Milan, Italy

[21] Appl. No.: 956,185

[22] Filed: Oct. 30, 1978

[30] Foreign Application Priority Data

Nov. 17, 1977 [IT] Italy ..... 29764 A/77

[51] Int. Cl.[2] ..... B67D 5/42

[52] U.S. Cl. ..... 222/321; 222/341; 222/383; 222/496

[58] Field of Search ..... 417/550, 552; 239/333; 222/320–321, 335, 341, 383, 385, 495–496

[56] References Cited

U.S. PATENT DOCUMENTS

| | | | |
|---|---|---|---|
| 3,008,611 | 11/1961 | Mancusi, Jr. | 222/496 X |
| 3,908,870 | 9/1975 | Nozawa et al. | 222/321 |
| 3,923,250 | 12/1975 | Boris | 222/321 |

FOREIGN PATENT DOCUMENTS

| | | | |
|---|---|---|---|
| 2310163 | 12/1976 | France | 222/321 |
| 1189592 | 4/1970 | United Kingdom | 417/550 |

*Primary Examiner*—Charles A. Marmor

[57] ABSTRACT

Reciprocating manual dispensing pump comprising a delivery valve provided with a shutter and associated with the movable part of the pump, and a suction or intake valve comprising a single piston movable against a spring within a tubular body forming therewith a compression chamber, which is hydraulically connected with an expansion chamber of a larger cross-section in the piston defined by a resiliently deformable part with which the delivery valve shutter is associated for closing a delivery conduit in such a piston.

6 Claims, 1 Drawing Figure

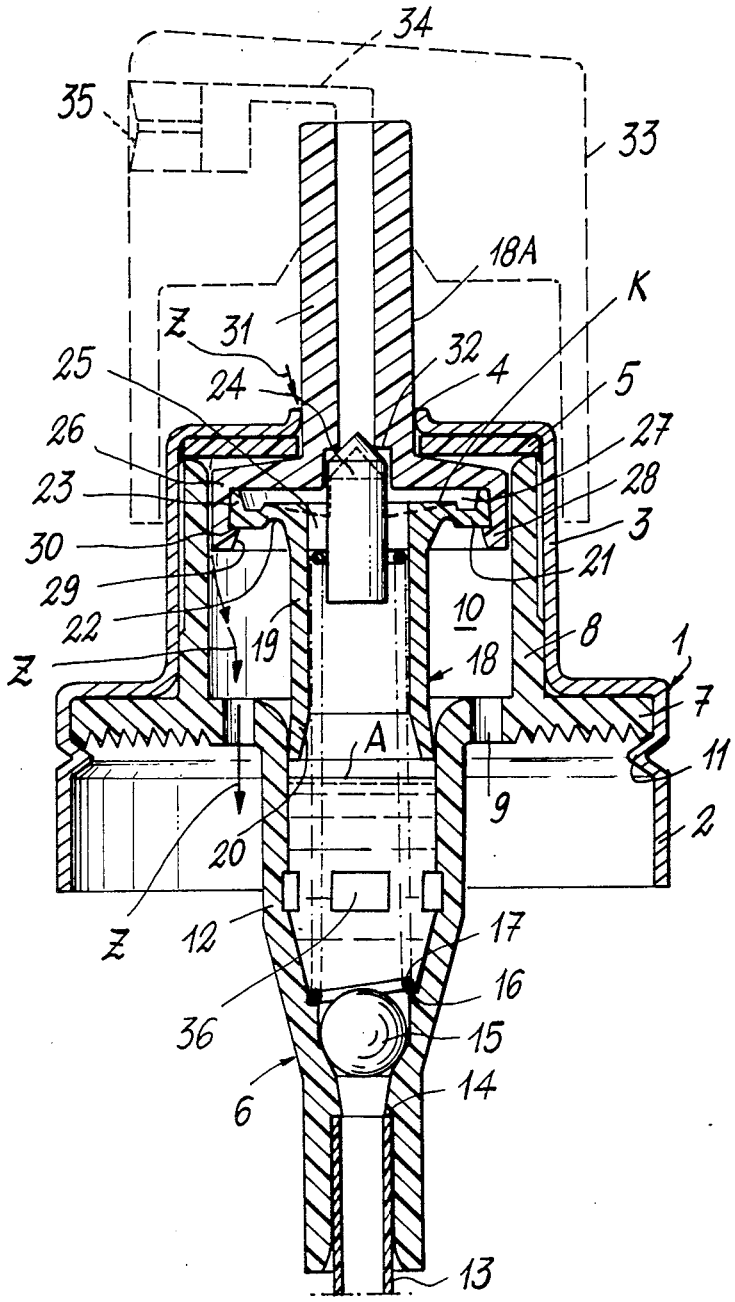
34
35
33
18A
K
Z
31
32
4
5
25
24
26
27
23
28
30
3
29
21
22
10
19
8
Z
18
1
7
A
11
9
2
20
Z
12
17
16
36
15
14
6
13

MANUAL CONTROL DISPENSING PUMP FOR LIQUID CONTAINERS

TECHNICAL FIELD

This invention relates to a manual control pump for dispensing liquids from containers. More particularly, but not exclusively, a pump according to the invention is for dispensing liquids in atomized form, such as perfumes, eau-de-Cologne or the like, contained in containers or bottles, to which the pump is connected, for example by screwing through a ring nut, or by seaming through a metal cap.

BACKGROUND OF THE PRIOR ART

Some hazard having been found from a sanitary standpoint in the use of propellants comprising halogenated hydrocarbons, such as Freons, there is at present a tendency of avoiding the use thereof for dispensing as an aerosol in the case of several products, such as, for example, cosmetic products. The present tendency is to follow two ways for at least partially eliminating the use of such propellants. A first way consists of using harmless propellants, such as $CO_2$, while the second way contemplates at least partially eliminating the propellant (either $CO_2$ or halogenated hydrocarbons) by using manual pumps allowing the liquid to be dispensed to a relatively high pressure, thus obtaining an atomization thereof when the liquid reaches the atmosphere.

The known prior art dispensing pumps made by moulding of plastics material substantially comprise two pistons moving in unison against a spring for at least some length of the stroke thereof and relatively to each other during a successive length of such a stroke. This relative movement allows the opening of a delivery valve (generally comprising a projection of one piston cooperating with a port or passage in the other piston) and accordingly the dispensing of pressurized liquid through a nozzle.

These known pumps of the prior art suffer from some disadvantages reflecting on the functionality thereof. Thus, the two pistons should be provided with seals creating substantial friction along the walls of cylinders in which such pistons are slidably mounted. In addition, the provision of seals involves the implementation of complicated and precise moulds.

BRIEF SUMMARY OF THE INVENTION

It is the object of the present invention to provide a low friction type of pump which is of a simpler construction than the known pumps.

This object and further objects that will become more apparent from the following detailed description are attained by a manual pump comprising a delivery valve associated with the movable part of the pump and a suction or intake valve, characterized by including a single piston moving against a spring and sealingly slidably mounted in a tubular body, therewith forming a compression chamber, which is hydraulically connected with an expansion chamber also provided in the piston and defined by a resiliently deformable wall, having integral therewith the shutter of the delivery valve for closing a delivery conduit in such a piston.

BRIEF DESCRIPTION OF THE DRAWING

The invention will be more clearly understood from the following detailed description, given by mere way of unrestrictive example of preferred embodiments thereof, shown in the accompanying drawing, in which:

the single FIGURE is an axial sectional view showing the pump provided with a ball suction or intake valve.

DETAILED DESCRIPTION OF THE INVENTION

Referring to the FIGURE of the accompanying drawing, reference numeral 1 designates as a whole a metal cap which is effective for supporting the pump and connecting it to the container having therein the liquid to be dispensed. The connection to the container neck may be accomplished by seaming (that is to say, by bending the side 2 about and below an edge or collar of the bottle neck).

At its raised central portion 3 said cap 1 has an aperture 4.

An annular resilient gasket 5 adheres against the inner face of the top wall of said part 3, and has on the opposite side sealingly adhering thereto the upper contour of a cylindrical wall 8 of a hollow body, designated as a whole at 6, which has a flange 7 provided internally of said wall 8 with a series of holes 9, the function of which is to communicate chamber 10 defined by wall 8, flange 7 and seal 5 with the inside of the bottle. An inner rim 11 is for retaining body 6 to cap 1 and urging the top end of wall 8 against seal 5.

Below said flange 7, hollow body 6 extends with a tubular extension, having as shown an internally and externally cylindrical length 12, a length which is substantially frusto-conical both internally and externally having a suction tube 13 inserted therein and abutting against an inner step 14.

In the conical length a ball 15 is located sealing against the inner wall of such length and comprising the suction or intake valve of the pump. Preferably, hollow body 6 is moulded of polypropylene or rigid polyethylene.

The lower end of a compression spring 17 bears on an inner step 16 of the conical length, while the other end abuts against an inner face of a piston which is formed of two parts 18 and 18A. Part 18 comprises a cylindrical skirt or apron 19, at the bottom terminating with a conical edge 20 sealing along the inner face of cylindrical length 12 of body 6. This said part 18 includes a flange 21 having an annular relieving groove 22 and contour and spacing side 23. This first part further centrally comprises a valve extension 24 surrounded by a series of through holes 25 internally of said skirt or apron 19. This first part 18 is moulded of soft polyethylene and is accordingly provided with a considerable elastic deformability.

Flange 21 is snap connected with the second part 18A of the piston which to this purpose comprises a cylindrical head 26 provided with a seating defined at the bottom by a collar 28. Thus, a so-called expansion chamber 27 is obtained. This collar 28 has a conical face 29 for aiding in inserting said flange 21 in the head, and a face 30 at right angles to the flange for firmly retaining it in such a seating. The whole height of flange 21 along its outer contour is substantially equal to the distance between face 30 and the top wall of chamber 27.

Head 26 is floatingly mounted, hence with negligible friction within chamber 10.

Head 26 extends with a tubular extension or stem 31 projecting through aperture 4. The bore through the stem has two lengths of different diameter separated by a step 32. The shuttering extension 24 seals against the step.

A pushbutton 33 provided with channels 34 communicating with the stem hole and an atomizing nozzle 35 is slipped over stem 31. Said pushbutton and nozzle are of known type.

The operation is as follows:

Assume that from a preceding delivery or dispensing operation there is some liquid in hollow body 6 up to the level shown at A. By pressing pushbutton 33, piston 18 is lowered compressing the underlying fluid (liquid plus air). On continued pressing or lowering of the pushbutton, the pressure would increase.

The pressure acts upon the top face K of part 18, giving rise to a downward thrust. The pressure is also effective on a surface of part 18 corresponding to the annular projection of conical edge 20, giving rise to an upward thrust which adds to that of spring 17.

Because of the larger extent of face K, the downward thrust will at a given time overcome the opposite thrust by an amount just sufficient to resiliently deform surface K, the latter taking the pattern illustrated by broken line, and as a result said valve 24 will be moved away from the sealing seat. Thereby, the compressed fluid inflows to stem 31 and is atomized as it is expelled from nozzle 35.

At the end of the pressing action exerted on pushbutton 33, valve 24 moves back to its closed position and spring 17 restores piston 18, 18A to starting position. During this upward stroke, the liquid is drawn from the bottle into the pump. The air to compensate for this displaced liquid reaches the bottle through the clearances between the parts or elements, following the path indicated by arrows Z.

In order to facilitate the pump priming and quickly evacuate the air between the sealing rim 20 and ball 15, at the final stage of its stroke the rim 20 passes the series of slots 36 in the cylindrical body 12.

Any previously compressed air will escape or leak, restoring the pressure within the chamber defined by ball 15 and rim 20 to atmospheric pressure.

In its return movement and after passing said slots 36 due to the action of spring 17, rim 20 will provide a seal on the cylindrical body, drawing the liquid through valve 15.

It is within the scope of the present invention to replace the ball suction valve by equivalent devices.

What is claimed is:

1. A reciprocating manual dispensing pump comprising:

a body having a single pumping cylinder section;

a suction valve at one end of said pumping cylinder section;

a hollow piston, said piston further comprising:

a smaller diameter section operating within and slidingly sealed at one end to the walls of said pumping cylinder, said smaller diameter section being of a length equal to the maximum reciprocating stroke of said pump;

a larger diameter section composed of resiliently deformable material and having upper and lower walls defining an internal chamber hydraulically connected to said smaller diameter section, said upper and lower walls being connected to one another, said lower wall being attached to said smaller diameter section at the end of said smaller diameter section opposite said slidingly sealed end;

an outlet tube extending from said upper end of said larger diameter section in the direction opposite said smaller diameter section;

a valve projection on the inner surface of said lower wall, said projection being located opposite to said outlet tube, said projection being of sufficient length and diameter to close the opening to said outlet tube when the larger diameter section is undeformed, whereby said outlet is closed until internal pressure displaces said projection by deformation of said chamber; and a spring within said pumping cylinder section, said spring providing a restoring force to said piston.

2. A pump according to claim 1, wherein said piston comprises two snap-interconnected parts.

3. A pump according to claim 2, wherein the first said part is provided with a flange having a peripheral side and the second of said parts has a cylindrical collar at one end, said collar having a sealing rim, and wherein said flange is snap connected behind said sealing rim, forming the expansion chamber between said parts.

4. A pump according to claim 3, wherein the first piston part is moulded of soft polyethylene.

5. A pump according to claim 1, wherein the pump body further comprises a cylindrical part having said larger diameter portion of said piston moving therein, a perforated flange for sealing said body to a container, and a tubular extension, the maximum inner diameter of which is less than that of said larger piston diameter.

6. A pump according to claim 1, wherein at least one groove is provided in the inner wall of said pumping cylinder body for bypassing of compressed air during the final stage of the piston stroke.

* * * * *